US008905507B2

(12) United States Patent
Mitsuki

(10) Patent No.: US 8,905,507 B2
(45) Date of Patent: Dec. 9, 2014

(54) INKJET PRINTER AND IMAGE RECORDING METHOD

(75) Inventor: Kiyoomi Mitsuki, Kyoto (JP)

(73) Assignees: SCREEN Holdings Co., Ltd., Kyoto (JP); Seiko Epson Corporation, Tokyo (JP)

( * ) Notice: Subject to any disclaimer, the term of this patent is extended or adjusted under 35 U.S.C. 154(b) by 48 days.

(21) Appl. No.: 13/621,030

(22) Filed: Sep. 15, 2012

(65) Prior Publication Data

US 2013/0083104 A1 Apr. 4, 2013

(30) Foreign Application Priority Data

Sep. 30, 2011 (JP) ..... P2011-216091

(51) Int. Cl.
*B41J 29/38* (2006.01)

(52) U.S. Cl.
USPC ..... 347/10; 347/11; 347/19

(58) Field of Classification Search
USPC ..... 347/5, 9, 10–13, 19
See application file for complete search history.

(56) References Cited

U.S. PATENT DOCUMENTS

| | | | | |
|---|---|---|---|---|
| 6,328,395 | B1 | 12/2001 | Kitahara et al. | |
| 6,464,315 | B1 * | 10/2002 | Otokita et al. | 347/9 |
| 6,890,061 | B1 * | 5/2005 | Freire et al. | 347/42 |
| 2002/0012017 | A1 * | 1/2002 | Yonekubo | 347/10 |

FOREIGN PATENT DOCUMENTS

| | | | |
|---|---|---|---|
| JP | 10-081012 | A | 3/1998 |
| JP | 2005-212411 | A | 8/2005 |

* cited by examiner

*Primary Examiner* — Lam S Nguyen
(74) *Attorney, Agent, or Firm* — McDermott Will & Emery LLP

(57) ABSTRACT

In an inkjet printer, for forming a large dot on a recording paper in the course of image recording, a second ejection pulse (721) and a first ejection pulse (713) are selected from a basic waveform (70), as a driving signal. For forming a medium dot, a first minute pulse (711) and the first ejection pulse (713) are selected. For forming a small dot, a third ejection pulse (722) is selected. At the time of non-ejection, a second minute pulse (712) is selected. As a result, by adjusting the waveform of the first minute pulse (711), it is possible to form high-quality dots of respective sizes while shortening a driving cycle with the use of the first ejection pulse (713) for forming a large dot and a medium dot.

13 Claims, 6 Drawing Sheets

INKJET PRINTER AND IMAGE RECORDING METHOD

TECHNICAL FIELD

The present invention relates to an inkjet printer for recording an image on an object, and to an image recording method adopted in an inkjet printer.

BACKGROUND ART

Conventionally, an inkjet printer which includes a head having a plurality of outlets and controls ejection of fine droplets of ink from each of the outlets while moving the head relatively to an object, to thereby record an image, has been used. In such inkjet printer, ejection of droplets is accomplished by input of an ejection pulse to a piezoelectric element provided in the neighborhood of each outlet of the head, for example. According to a method disclosed in Japanese Patent Application Laid-Open No. 10-81012, a driving signal output per printing cycle consists of four driving pulses of a first pulse, a second pulse, a third pulse, and a fourth pulse, and a diameter of a dot recorded on a recording paper is variably controlled by appropriately selecting one or some of the driving pulses, to thereby achieve multiple tone printing.

Also, according to a method disclosed in Japanese Patent Application Laid-Open No. 2005-212411, a gentle vibration signal which vibrates meniscus in a nozzle so gently that ejection of ink in channels from the nozzle can be avoided is continuously applied to all channels regardless of presence or absence of image data, and an ink ejection signal is generated by including therein the gentle vibration signal depending on image data, to thereby constantly record a high-quality image with high reliability.

Meanwhile, in recent years, there is a demand for high-speed recording of an image, so that a cycle for input of a driving signal to a head is becoming shorter. Along with this, limitations are put to a waveform of an ejection pulse which causes ejection of a droplet in a driving signal, and thus, in some cases, it is difficult to form a dot of a desired size by using only one ejection pulse. While there is an approach of using a combination of a plurality of ejection pulses to form a dot of a desired size, use of a plurality of ejection pulses in forming dots of respective sizes results in increase in the number of ejection pulses included in a driving signal. Accordingly, the driving signal becomes too long to cope with speed enhancement in image recording. In a case where a driving signal including a gentle vibration pulse is generated at the time of non-ejection, it is more difficult to attain a driving signal which satisfactorily forms dots of respective sizes while achieving high-speed image recording.

SUMMARY OF INVENTION

The present invention is directed to an inkjet printer, and it is an object of the present invention to form a high-quality dot in a short driving cycle.

An inkjet printer according to one embodiment of the present invention, includes a recording part for ejecting droplets of ink from an outlet toward an object, to form dots of at least one size on the object; a moving mechanism for moving the object relatively to the recording part in a moving direction; and a controller for sequentially inputting signals to the recording part, the signals being instructions for ejection of droplets, in parallel with movement of the object relative to the recording part, wherein a driving signal used for ejection of a droplet is generated by selecting a part of a plurality of waveform elements included in a basic waveform in accordance with instructions given by the controller, the plurality of waveform elements include an ejection pulse used for ejection of a droplet and a plurality of minute pulses preceding the ejection pulse, in forming no dot on the object, a first minute pulse group which is at least a part of the plurality of minute pulses is selected, to achieve non-ejection in the recording part, in forming a dot of one size included in the at least one size, a second minute pulse group which is at least a part of the plurality of minute pulses and the ejection pulse are selected, to achieve ejection of a droplet from the outlet, and the first minute pulse group and the second minute pulse group have different waveforms.

According to the present invention, as ejection is achieved with the use of a minute pulse group having a waveform which is different from the waveform of the minute pulse group used at the time of non-ejection, a high-quality dot can be formed in a short driving cycle.

The present invention is also directed to an image recording method being executed in an inkjet printer.

These and other objects, features, aspects and advantages of the present invention will become more apparent from the following detailed description of the present invention when taken in conjunction with the accompanying drawings.

BRIEF DESCRIPTION OF DRAWINGS

Figure 1:
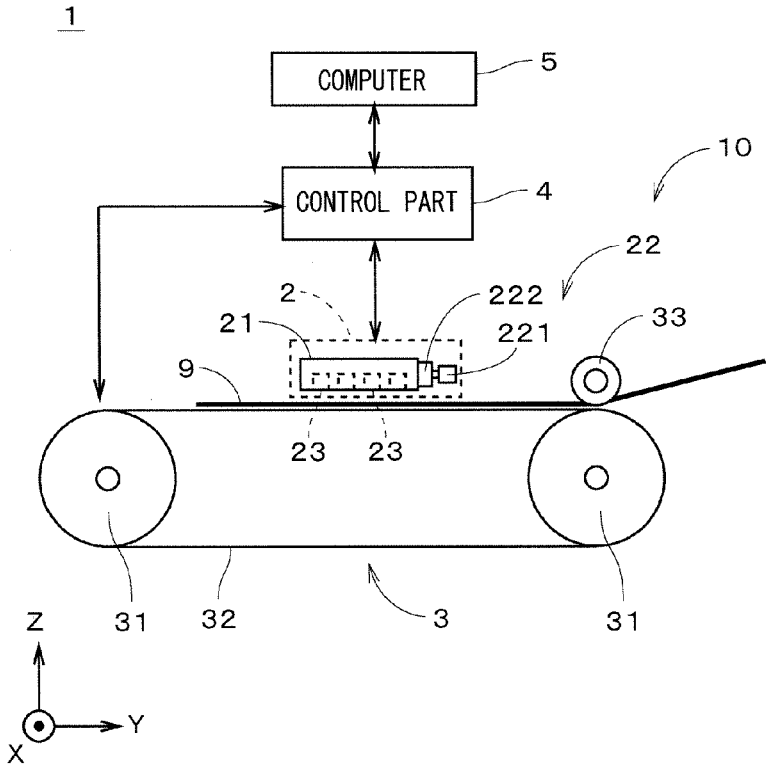
FIG. 1 illustrates a structure of an inkjet printer.

FIG. 1 illustrates a structure of an inkjet printer 1 according to a preferred embodiment of the present invention. The inkjet printer 1 includes a body 10 and a computer 5 connected with the body 10. The body 10 includes a recording part 2 for ejecting fine droplets of ink toward a recording paper 9, a paper feeding mechanism 3 for feeding the recording paper 9 in the (−Y) direction in FIG. 1 under the recording part 2 (on the (−Z) side of the recording part 2), and a control part 4 connected with the recording part 2 and the paper feeding mechanism 3.

The paper feeding mechanism 3 includes two belt rollers 31 connected with a motor not illustrated, and a belt 32 laid on the two belt rollers 31. Each region in the recording paper 9 which is a continuous paper is guided onto the belt 32 via a roller 33 provided above one of the belt rollers 31 which is placed on the (+Y) side, held on the belt 32, and moved toward the (−Y) side, passing a space under the recording part 2, together with the belt 32. Also, an encoder 34 (refer to FIG. 3) is provided in the belt rollers 31 of the paper feeding mechanism 3. In the following description, the direction of movement (i.e. moving direction) of the recording part 2 relative to the recording paper 9 (the Y-direction) will be referred to as a scanning direction. Meanwhile, in the paper feeding mechanism 3, a suction part may be provided at a position facing the recording part 2 in the inner side of the ring-shaped belt 32. In such suction part, minute suction holes are formed in the belt 32 so that the recording paper 9 can be held on the belt 32 by suction and absorption.

The recording part 2 includes a head unit 21 including a plurality (four in the preferred embodiment) of heads 23. The plurality of heads 23 respectively eject ink in cyan (C), magenta (M), yellow (Y), and black (K), and are arranged in the Y-direction.

Figure 2:
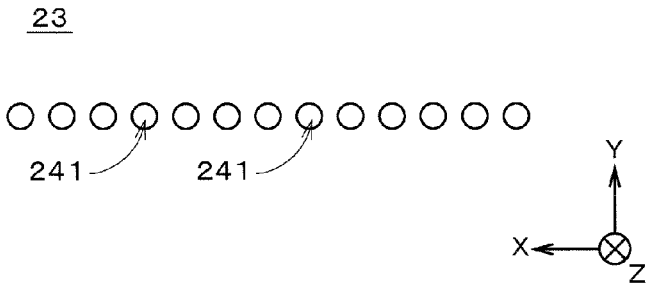
FIG. 2 is a bottom plan view of a head.

FIG. 2 is a bottom plan view illustrating a part of one of the heads 23. In FIG. 2, the scanning direction of the recording part 2 relative to the recording paper 9 (i.e., the Y-direction) is vertically illustrated. In a bottom surface of each of the heads 23, a plurality of outlets 241 are formed and arranged with a predetermined pitch in a direction which is perpendicular to the scanning direction and goes along the recording paper 9 (the direction is the X-direction in FIG. 1 and corresponds with a width of the recording paper 9 so that the direction will be also referred to as a "width direction" in the following description). The plurality of outlets 241 are not necessarily arranged linearly so long as a predetermined pitch is kept in the width direction.

A piezoelectric element 232 (refer to FIG. 3) is provided for each of the outlets 241 in the head 23. Thus, to drive the piezoelectric element 232 causes ejection of a droplet of ink from the outlet 241 toward the recording paper 9. In practice, by controlling drive of the piezoelectric element 232, droplets in different amounts can be ejected from the outlets 241. As a result of this, a dot of a small size, a dot of a medium size, and a dot of a large size can be formed on the recording paper 9 (in the following description, those dots will be referred to as a "small dot", a "medium dot", and a "large dot", respectively). The plurality of outlets 241 are arranged to cover the whole width of a recording area of the recording paper 9 in the width direction. Thus, in the inkjet printer 1, by only one-time passage of the recording paper 9 under the recording part 2 (so called, by single-pass printing), image recording can be completed in a short period of time.

Further, the recording part 2 in FIG. 1 includes a head moving mechanism 22 which moves the head unit 21 in the width direction. The head moving mechanism 22 includes a ring-shaped timing belt 222 which is slim and long along the width direction. The timing belt 222 is rotated by the motor 221, so that the head unit 21 smoothly moves in the width direction. At the time of non-recording in the inkjet printer 1, the head moving mechanism 22 places the head unit 21 at a predetermined stand-by position, where the plurality of outlets 241 of each of the heads 23 are covered with a lid member, to prevent the outlets 241 from being clogged because of drying of ink in the neighborhood of the outlets 241.

Figure 3:
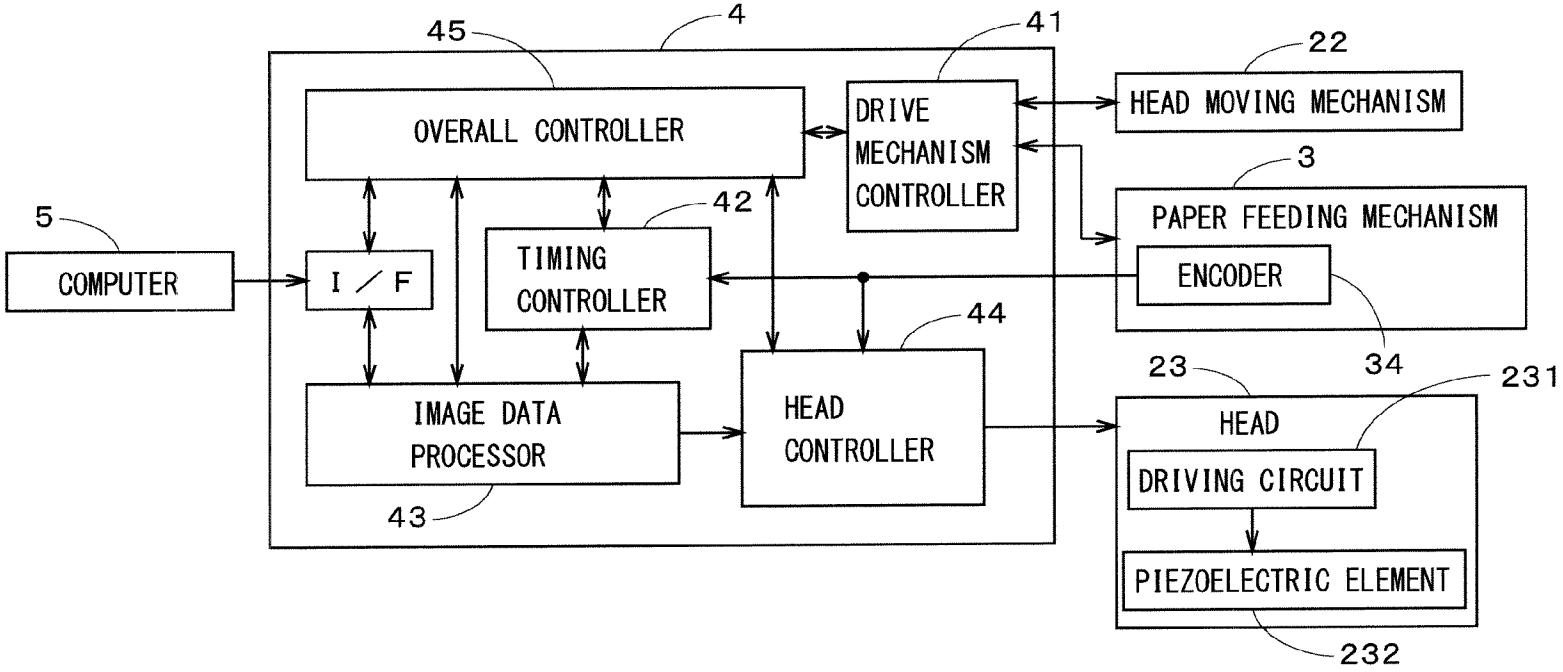
FIG. 3 is a functional block diagram illustrating functions of the inkjet printer.

FIG. 3 is a functional block diagram of the inkjet printer 1. The control part 4 includes a drive mechanism controller 41 for controlling drive of the head moving mechanism 22 and the paper feeding mechanism 3, a timing controller 42 which receives an encoder signal from the encoder 34 of the paper feeding mechanism 3 and controls the time when droplets are ejected from the outlets 241 of the heads 23, an image data processor 43 for receiving original image data which is to be recorded from the computer 5 via an interface (I/F) and generating drawing data for the heads 23 by using the received original image data, a head controller 44 which is connected with the heads 23 and controls the heads 23 based on the drawing data, and an overall controller 45 responsible for overall control of the control part 4. It is noted that though only one head 23 is illustrated in FIG. 3 for the sake of convenience in illustration, a signal is input to each of the plurality of heads 23 from the head controller 44 in practice. While the following description will be made focusing on one head 23, the same process is performed in each of the other heads 23. Since the head 23 is a part of the recording part 2, the structure of the head 23, the operations of the head 23, and input of a signal to the head 23 are equivalent to the structure of the recording part 2, the operations of the recording part 2, and input of a signal to the recording part 2.

In the head 23, a driving circuit 231 is provided for each of the respective piezoelectric elements 232 of the plurality of outlets 241, and signals which give instructions for ejecting droplets are sequentially input to the driving circuits 231 from the head controller 44. It is noted that in FIG. 3, only one driving circuit 231 and only one piezoelectric element 232 are illustrated.

Figure 4:
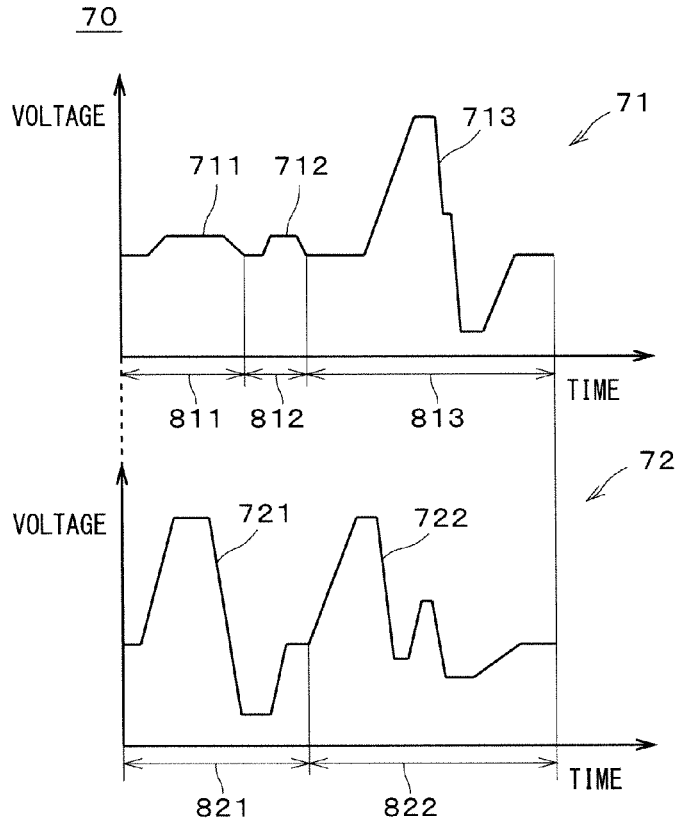
FIG. 4 illustrates a basic waveform.

FIG. 4 illustrates a basic waveform 70 generated in the head controller 44. In each of an upper area and a lower area in FIG. 4, a vertical axis represents a voltage and a horizontal axis represents time. The basic waveform 70 consists of two waveform-element sequences 71 and 72, and the waveform-element sequence 71 in the upper area of FIG. 4 and the waveform-element sequence 72 in the lower area of FIG. 4 are generated in parallel with each other. The waveform-element sequence 71 in the upper area includes three pulses 711, 712, and 713, and respective time durations of those pulses are denoted with reference numerals "811", "812", and "813". The waveform-element sequence 72 in the lower area includes two pulses 721 and 722, and respective time durations of those pulses are denoted with reference numerals "821" and "822". The starting time of the duration 813 and the starting time of the duration 822 coincide with each other. A voltage at a starting position and an ending portion of each pulse is a constant reference voltage.

Each of the pulses serves to cause the piezoelectric element 232 to perform at least a part of a series of operations. The pulse 713 in the upper area and the pulses 721 and 722 in the lower area are used for ejection of a droplet, and each of the foregoing pulses is great enough to solely cause ejection of a droplet from the outlet 241. In the following description, the foregoing pulses will be referred to as a "first ejection pulse 713", a "second ejection pulse 721", and a "third ejection pulse 722", respectively. Each of the pulses 711 and 712 in the upper area is a minute pulse which is too small to solely cause ejection of a droplet in principle, and those pulses will be hereinafter referred to as a "first minute pulse 711" and a "second minute pulse 712", respectively. The maximum value of a difference between the reference voltage and a minute pulse is smaller than the maximum value of a difference between the reference voltage and an ejection pulse.

The head controller 44 repeatedly provides the basic waveform 70 and a control signal for selecting a pulse(s), to the driving circuit 231. The driving circuit 231 selects a pulse(s), so that a driving signal is repeatedly provided to the corresponding piezoelectric element 232. Thus, the length of the basic waveform 70 is equal to a driving cycle of the driving circuit 231. More specifically, the head controller 44 repeatedly provides the waveform-element sequences 71 and 72 to the driving circuit 231, and in parallel therewith, provides a control signal attaching "1" to a pulse which should be selected and attaching "0" to a pulse which should not be selected, to the driving circuit 231. In the driving circuit 231, pulses to which "1" are attached are extracted from the two waveform-element sequences 71 and 72 and combined, to generate a driving signal.

Figure 5:
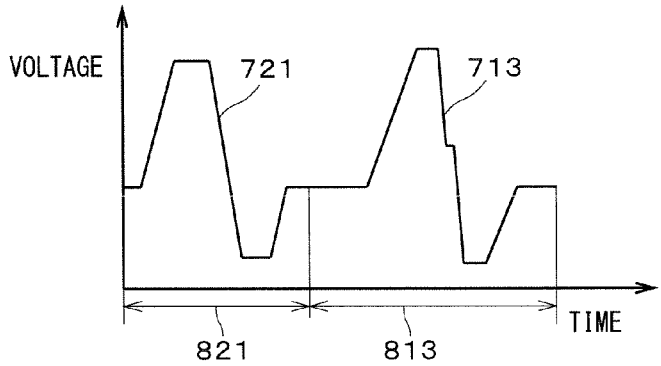
FIG. 5 illustrates a driving signal used for a large dot.

For example, to the driving circuit 231 which ejects a droplet (alternatively, a collection of droplets) used for a large dot, the two waveform-element sequences 71 and 72 are input, and further, a control signal which indicates "1" only in the duration 821 is input, regarding the waveform-element sequence 72 in the lower area in FIG. 4. Accordingly, only the second ejection pulse 721 is extracted from the waveform-element sequence 72. Regarding the waveform-element sequence 71 in the upper area, a control signal which indicates "1" only in the duration 813 is input, so that the first ejection pulse 713 is extracted from the waveform-element sequence 71. As a result, in the driving circuit 231, a driving signal which includes the second ejection pulse 721 and the first ejection pulse 713 arranged in this order as illustrated in FIG. 5 is generated, and the thus generated driving signal is input to the corresponding piezoelectric element 232.

In the outlet 241, ejecting operation of a droplet associated with the second ejection pulse 721 is made in advance, and subsequently, ejecting operation of a droplet associated with the first ejection pulse 713 is made, so that a large dot is formed on the recording paper 9. It is noted that each of the number of droplets associated with the second ejection pulse 721 and the number of droplets associated with the first ejection pulse 713 is not limited to one.

Figure 6:
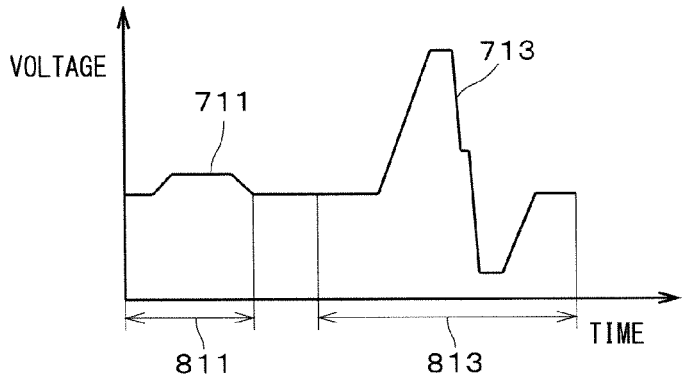
FIG. 6 illustrates a driving signal used for a medium dot.

To the driving circuit 231 which ejects a droplet used for a medium dot, the two waveform-element sequences 71 and 72 are input, and further, a control signal which indicates "1" only in the durations 811 and 813 regarding the waveform-element sequence 71 in the upper area in FIG. 4, and a control signal which indicates "0" in all the durations in the waveform-element sequence 72 in the lower area, are input. Accordingly, a driving signal formed by extracting only the first minute pulse 711 and the first ejection pulse 713 from the waveform-element sequence 71 as illustrated in FIG. 6 is generated. In a period of time between the durations 811 and 813 in which no pulse is selected in FIG. 6, the reference voltage is maintained. In the outlet 241, after a liquid surface is gently vibrated by the first minute pulse 711, ejection of a droplet associated with the first ejection pulse 713 is made, so that a medium dot is formed on the recording paper 9.

Figure 7:
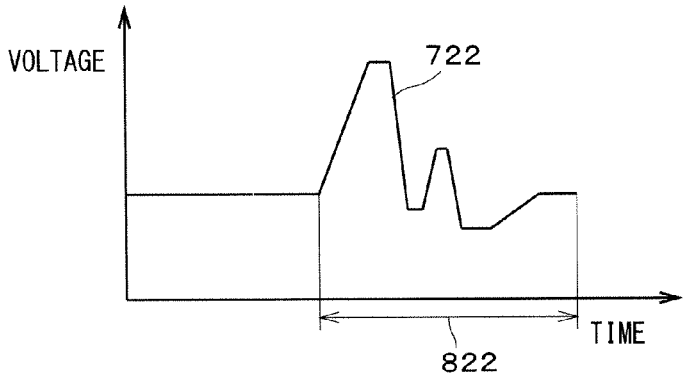
FIG. 7 illustrates a driving signal used for a small dot.

To the driving circuit 231 which ejects a droplet used for a small dot, the two waveform-element sequences 71 and 72 are input, and further, a control signal which indicates "0" in all the durations in the waveform-element sequence 71 in the upper area in FIG. 4, and a control signal which indicates "1" only in the duration 822 regarding the waveform-element sequence 72 in the lower area, are input. Accordingly, a driving signal formed by extracting only the third ejection pulse 722 from the waveform-element sequence 72 as illustrated in FIG. 7 is generated. In the outlet 241, ejection of a droplet associated with the third ejection pulse 722 is made, so that a small dot is formed on the recording paper 9.

Figure 8:
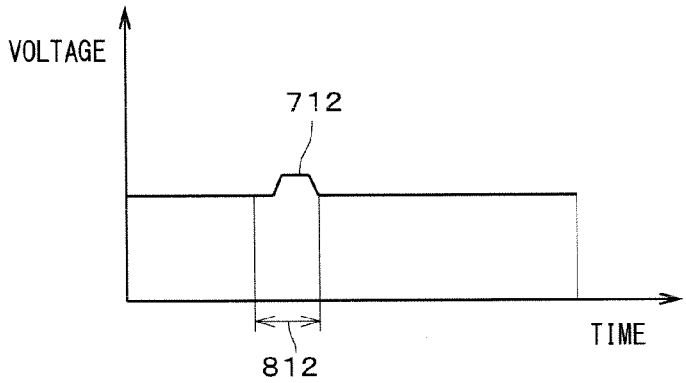
FIG. 8 illustrates a driving signal used at the time of non-ejection.

To the driving circuit 231 which ejects no droplet in the course of one cycle of the basic waveform 70, the two waveform-element sequences 71 and 72 are input, and further, a control signal which indicates "1" only in the duration 812 regarding the waveform-element sequence 71 in the upper area in FIG. 4, and a control signal which indicates "0" in all the durations in the waveform-element sequence 72 in the lower area, are input. Accordingly, a driving signal formed by extracting only the second minute pulse 712 from the waveform-element sequence 71 as illustrated in FIG. 8 is generated. Thus, the reference voltage is maintained at all times except for the duration 812. In the outlet 241, only gentle vibration of a liquid surface is caused by the second minute pulse 712, as a non-ejection operation. Because of the gentle vibration, ink in the neighborhood of the outlet 241 is prevented from being hardened.

As is made clear from the above description, though an ultimate driving signal for driving the piezoelectric element 232 is generated in the driving circuit 231, an understanding that the head controller 44 substantially provides a driving signal to the driving circuit 231 of the head 23 is reasonable because the basic waveform and a control signal provided from the head controller 44 are equivalent to a driving signal.

Figure 9:
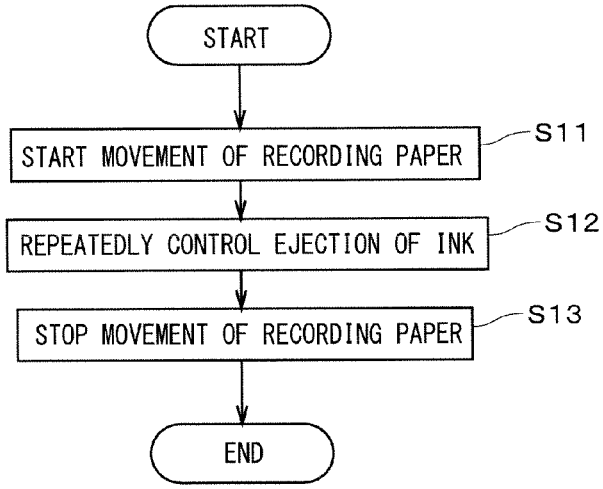
FIG. 9 is a flow chart illustrating a process of recording an image.

FIG. 9 is a flow chart illustrating a process performed in the inkjet printer 1 for recording an image on the recording paper 9. To achieve image recording in the inkjet printer 1, first, the drive mechanism controller 41 drives the head moving mechanism 22, so that the head unit 21 in FIG. 1 is moved from a standby position to a predetermined recording position in the X direction. Subsequently, upon drive of the paper feeding mechanism 3, continuous movement of the recording paper 9 is started (step S11). In parallel with the movement of the recording paper 9 relative to the recording part 2, the head controller 44 in FIG. 3 sequentially inputs the basic waveform 70 and a control signal which give instructions for ejection of a droplet, to the head 23. As a result, a part of a plurality of waveform elements included in the basic waveform 70 is selected, and a driving signal used for ejection of a droplet is generated in the driving circuit 231 and is provided to the piezoelectric element 232, so that ink is repeatedly ejected (step S12).

More specifically, a control signal which gives instructions for forming a large dot, forming a medium dot, forming a small dot, or non-ejecting, is input to each of the driving circuits 231, and held. On the other hand, every time the recording paper 9 travels a predetermined distance in the scanning direction, an ejection timing signal is generated by the timing controller 42 based on an output provided from the encoder 34. In the head 23, in synchronization with the ejection timing signal, each of the plurality of driving circuits 231 selects a waveform element from the basic waveform in accordance with a control signal, to generate a driving signal, and provides the generated driving signal to the piezoelectric element 232. As a result, ejection of ink is achieved in each of the plurality of outlets 241 with desired timing. Then, in the course of image recording, the foregoing process is repeatedly performed at high speed.

When an entirety of an image indicated by the original image data which is to be recorded is recorded on the recording paper 9 in the above-described manner, the movement of the recording paper 9 is stopped, to complete an image recording process of the inkjet printer 1 (step S13).

In the meantime, in the inkjet printer 1, a driving signal for a large dot employs the second ejection pulse 721 and the first ejection pulse 713, and a driving signal for a medium dot employs the first ejection pulse 713. Then, in a case where only the first ejection pulse 713 is used for forming a medium dot, the waveform of the first ejection pulse 713 for a medium dot should be determined, taking both of formation of a large dot and formation of a medium dot, into account. However, there arises various constraints to a basic waveform because of increase in speed of image recording, and thus it is difficult to determine the waveform of the first ejection pulse 713 for forming an appropriate medium dot.

In contrast thereto, in the inkjet printer 1, the first minute pulse 711, in addition to the first ejection pulse 713, is used for forming a medium dot. Accordingly, by adjusting the waveform, i.e., height, width, position, or the like, of the first minute pulse 711, it is possible to easily attain a driving signal for forming an appropriate medium dot. Since formation of a small dot employs the third ejection pulse 722 which is not used in forming either a large dot or a medium dot, the waveform of the third ejection pulse 722 can be easily determined. Further, the first minute pulse 711 is independent of the second minute pulse 712 used at the time of non-ejection, so that a driving signal for forming an appropriate medium dot can be more easily attained. Additionally, the first minute pulse 711 may be used at the time of non-ejection and the second minute pulse 712 may be used for forming a medium dot.

Figure 10:
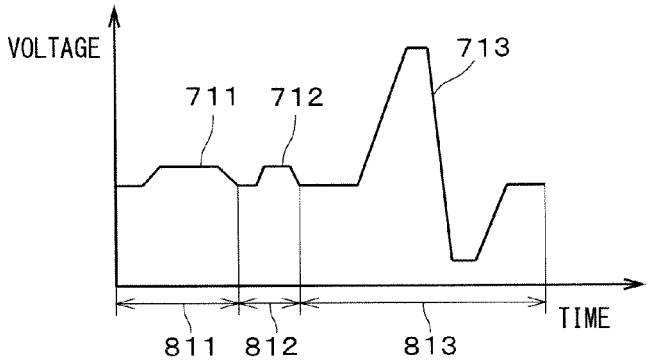
FIG. 10 illustrates another driving signal used for a medium dot.

FIG. 10 illustrates another example of a driving signal used for forming a medium dot. Respective driving signals used for formation of a large dot and formation of a small dot and a driving signal used at the time of non-ejection are the same as illustrated in FIGS. 5, 7, and 8. Referring to FIG. 10, in forming a medium dot, the first minute pulse 711, the second minute pulse 712, and the first ejection pulse 713 are selected from the basic waveform 70. Also in this example, by adjusting the waveform of the first minute pulse 711, it is possible to satisfactorily form both of a large dot and a medium dot while using the first ejection pulse 713 for forming a large dot and a medium dot.

Figure 11:
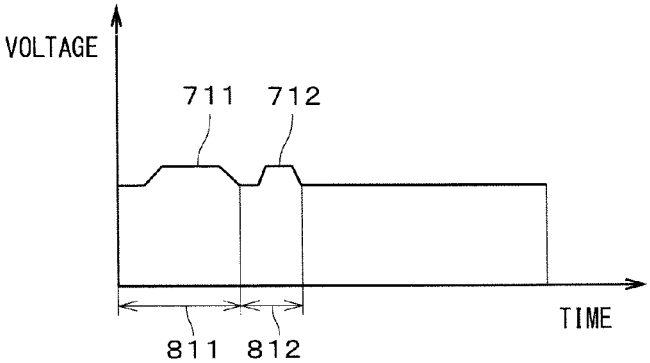
FIG. 11 illustrates another driving signal used at the time of non-ejection.

FIG. 11 is another example of a driving signal used at the time of non-ejection. Respective driving signals used for forming a large dot, a medium dot, and a small dot are the same as illustrated in FIGS. 5 to 7. Referring to FIG. 11, at the time of non-ejection, the first minute pulse 711 and the second minute pulse 712 are selected from the basic waveform 70. Also in this example, by adjusting the waveform of the first minute pulse 711, it is possible to appropriately form both of a large dot and a medium dot while using the first ejection pulse 713 for forming a large dot and a medium dot. Further, by adjusting the waveform of the second minute pulse 712, operations at the time of non-ejection can be optimized.

In all of FIGS. 5 to 8, 10, and 11, by using only two minute pulses 711 and 712 in the basic waveform 70 (except for an auxiliary minute pulse provided after an ejection pulse, which will be later described in detail), formation of high-quality dots of respective sizes can be achieved while keeping a driving cycle short. Since the basic waveform 70 consists of the two waveform-element sequences 71 and 72, a driving cycle can be considerably shortened. Further, as a minute pulse has a short duration, a driving cycle can be shortened by including the two minute pulses 711 and 712 in only one of the two waveform-element sequences 71 and 72, i.e., the waveform-element sequence 71.

In particular, the waveform-element sequence 71, includes only two minute pulses 711 and 712 and one ejection pulse 713, and the other waveform-element sequence 72 includes only the two ejection pulses 721 and 722, so that a large dot, a medium dot, and a small dot, of high quality, can be formed in a short driving cycle and optimal operations for non-ejection can be performed. To put it more generally, when the numbers of ejection pulses included in two waveform-element sequences are different from each other, a driving cycle can be shortened by including a plurality of minute pulses in one of the two waveform-element sequences which includes the smaller number of ejection pulses.

A short basic waveform is suitable for an inkjet printer which records an image at high speed, and particularly suitable for an inkjet printer which records an image by single-pass printing.

Figure 12:
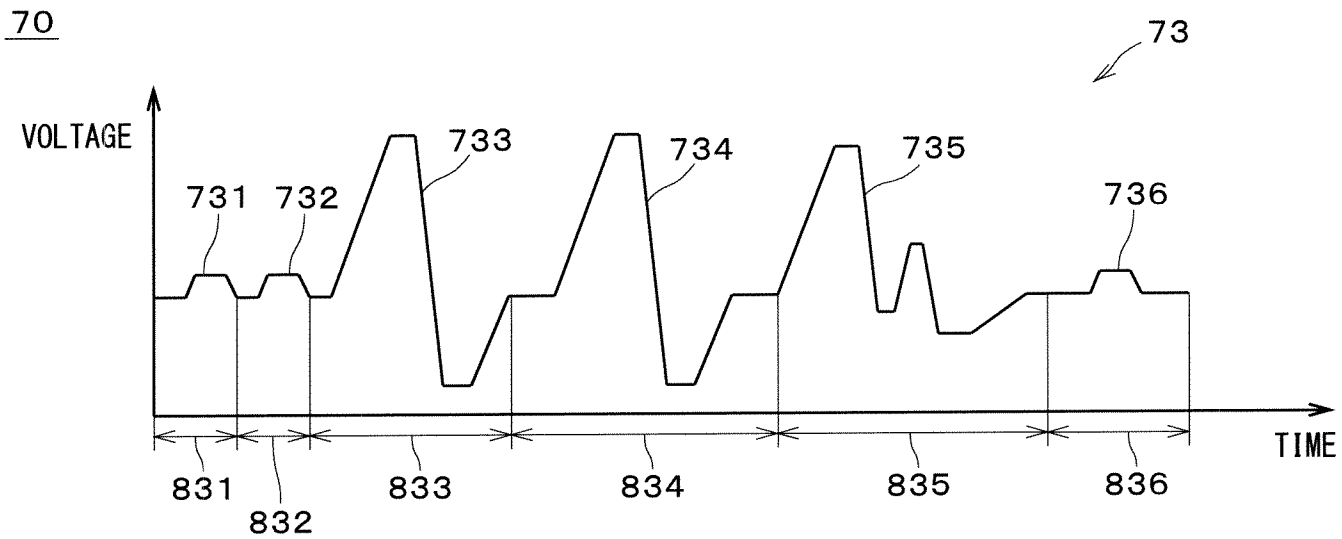
FIG. 12 illustrates another basic waveform.

FIG. 12 illustrates another example of the basic waveform 70. The basic waveform 70 illustrated in FIG. 12 is one waveform-element sequence 73. The basic waveform 70 in FIG. 12 includes a first minute pulse 731, a second minute pulse 732, a first ejection pulse 733, a second ejection pulse 734, a third ejection pulse 735, and an auxiliary minute pulse 736 which are arranged in this order. The respective time durations of those pulses are denoted with reference numerals 831 to 836. As for a driving signal, in generating a driving signal used for forming a large dot, for example, the first ejection pulse 733, the second ejection pulse 734, and the auxiliary minute pulse 736 are selected. In generating a driving signal used for forming a medium dot, the first minute pulse 711, the second ejection pulse 734, and the auxiliary minute pulse 736 are selected. In generating a driving signal used for forming a small dot, the third ejection pulse 735 and the auxiliary minute pulse 736 are selected. In generating a driving signal used at the time of non-ejection, only the second minute pulse 732 is selected.

Accordingly, as is the case with the basic waveform 70 illustrated in FIG. 4, the first minute pulse 731, in addition to the second ejection pulse 734, is used for forming a medium dot, so that it is possible to easily attain a driving signal for appropriately forming a large dot and also appropriately forming a medium dot. Further, since the first minute pulse 731 is independent of the second minute pulse 732 used at the time of non-ejection, it is possible to more easily attain a driving signal used for appropriately forming a medium dot. As a result, a high-quality dot can be formed in a short driving cycle. Moreover, residual vibration of a liquid surface in the outlet 241 after ejection of droplets can be suppressed by the auxiliary minute pulse 736, so that operations for the next ejection can be performed in a stable situation.

As above, the preferred embodiment of the present invention has been described. However, the present invention is not limited to the above-described preferred embodiment, and various modifications are possible.

In the inkjet printer 1 described above, four instruction values which give instructions for forming a large dot, forming a medium dot, forming a small dot, and forming no dot, respectively (any of four tone values of dots) are input to the head 23 from the head controller 44. Unlike this, the head 23 may be so designed that four or more sizes of dots can be formed. In this case, five or more instructions values are input to the head 23. Conversely, three instruction values by which only two sizes of dots, a large dot and a medium dot, for example, are formed, may be input to the head 23. In this case, the third ejection pulse for a small dot is omitted in the above-described preferred embodiment, for example. Further, only one size of dot may be formed on the recording paper 9. In this case, a minute pulse which is selected in forming no dot on the recording paper 9 and a minute pulse which is selected in forming a dot are differentiated. Thus, the head 23 may be designed in any other way so long as the head 23 is able to form at least one size of dot on the recording paper 9.

In the above-described preferred embodiment, the number of minute pulses present prior to an ejection pulse may be three or more. At the time of non-ejection, at least one minute pulse is selected from the plurality of minute pulses. On the other hand, for forming one size of a dot, an ejection pulse is selected, and at least one minute pulse present prior to the selected ejection pulse is selected from the plurality of minute pulses. In this regard, at least one minute pulse selected at the time of non-ejection is referred to as a "first minute pulse group", and at least one minute pulse selected for forming a dot is referred to as a "second minute pulse group". Then, by differentiating the first minute pulse group and the second minute pulse group, in other words, by differentiating the respective waveforms of those minute pulse groups, it is possible to easily attain an appropriate driving signal used for forming a dot while shortening a driving cycle. In other words, a high-quality dot can be formed in a short driving cycle. Of course, also at the time of non-ejection, an appropriate driving signal can be attained. As a result, an image of high quality can be recorded at high speed.

An example of operations illustrated in FIGS. 5 to 8 corresponds to a case where the above-described plurality of minute pulses are two minute pulses, the first minute pulse group is one of the two minute pulses, and the second minute pulse group is the other. An example of operations illustrated in FIGS. 5, 10, 7, and 8 corresponds to a case where the above-described plurality of minute pulses are two minute pulses, the first minute pulse group is one of the two minute pulses, and the second minute pulse group is both of the two minute pulses. An example of operations illustrated in FIGS. 5, 6, 7, and 11 corresponds to a case where the above-described plurality of minute pulses are two minute pulses, the first minute pulse group is both of the two minute pulses, and the second minute pulse group is one of the two minute pulses.

In a case where a basic waveform includes a plurality of minute pulses preceding an ejection pulse, the number of minute pulses used at the time of non-ejection may be larger than, smaller than, or equal to, the number of minute pulses used for ejection. Further, in any case, the basic waveform may be one waveform-element sequence, or two waveform-element sequences.

In a case where a basic waveform is two waveform-element sequences, to provide a plurality of minute pulses before an ejection pulse (strictly, an ejection pulse used together with a minute pulse) in only one of the two waveform-element sequences could shorten a driving cycle. Further, if one of the two waveform-element sequences includes a plurality of minute pulses and the first ejection pulse and the other waveform-element sequence includes the second ejection pulse which is in line with the plurality of minute pulses in time, a driving signal can be efficiently shortened. Of course, regardless of whether the basic waveform is one waveform-element sequence or two waveform-element sequences, a plurality of minute pulses should be provided before an ejection pulse used together with the minute pulses (the first ejection pulse in the above-described preferred embodiment), in the plurality of waveform elements included in the basic waveform.

Moreover, while the first, second, and third ejection pulses are provided as ejection pulses in the above-described preferred embodiment, a basic waveform may further include another ejection pulse or another auxiliary minute pulse. General representation of preferable operations performed in a case where a basic waveform is two waveform-element sequences and four instruction values are input to the driving circuit 231 is as follows. A driving signal which includes the second ejection pulse and the first ejection pulse and does not include the third ejection pulse is generated in ejecting a droplet for a large dot from the head 23, a driving signal which includes at least a part of a plurality of minute pulses and the first ejection pulse and does not include either the second ejection pulse or the third ejection pulse is generated in ejecting a droplet for a medium dot, and a driving signal which includes the third ejection pulse and does not include either the first ejection pulse or the second ejection pulse is generated in ejecting a droplet for a small dot.

Furthermore, correlation of a minute pulse and an ejection pulse with a size of a dot may be more increasingly diversified. For example, in forming a small dot, at least one minute pulse and the third ejection pulse may be used. Alternatively, the third ejection pulse may be used for forming a medium dot, and the first ejection pulse may be used for forming a small dot. As for a driving signal used for forming a large dot, a signal including at lease one minute pulse and only one ejection pulse may be used. In any case, a minute pulse group having a waveform which is different from a waveform used at the time of non-ejection is used in forming a dot of one of sizes.

Either a part or a whole of the functions of the head controller 44 may be provided in the heads 23. Conversely, either a part or a whole of the functions of the driving circuits 231 may be provided outside of the heads 23.

While a minute pulse illustratively described in the above preferred embodiment has a waveform in a shape of an upward convex, such shape is just one example. A minute pulse may have a waveform in a shape of a downward convex or a shape in which an upward convex and a downward convex alternate.

In the inkjet printer 1, the recording paper 9 is caused to move relatively to the head 23 in the scanning direction by the paper feeding mechanism 3 serving as a scanning mechanism. Alternatively, a scanning mechanism which moves the head 23 in the Y direction may be provided. Further alternatively, the recording paper 9 may be held by a roller and the recording paper 9 may be caused to move relatively to the head 23 in the scanning direction by a motor rotating the roller. As is described, a scanning mechanism for moving the recording paper 9 relatively to the head 23 in the scanning direction may be implemented by various structures.

The inkjet printer may be of a type which records an image on a paper in the form of a sheet. For example, in an inkjet printer which holds a recording paper on a stage, the length of an array of a plurality of outlets arranged in the width direction is smaller than the width of a recording area of a recording paper, and a scanning mechanism which moves the head relatively to the recording paper in the scanning direction and the width direction is provided. Then, the head moves relatively to the recording paper in the scanning direction (main scanning) while ejecting ink, to reach the edge of the recording paper, and subsequently travels a predetermined distance relatively to the recording paper in the width direction (sub-scanning). Thereafter, the head moves relatively to the recording paper in a direction opposite to the direction of the previous main scanning while ejecting ink. Thus, in the foregoing inkjet printer, in addition to main scanning of the recording paper in the scanning direction being made by the head, intermittent sub-scanning in the width direction is made every time the main scanning is finished, so that an image is recorded over the whole of the recording paper. However, from the viewpoint of increase in speed in image recording, it is preferable to adopt the foregoing method which uses a non-ejection pulse for ejection of a droplet, in the inkjet printer 1 of a single-pass printing type in which image recording is completed only by one-time passage of the recording paper 9 under the head 23.

In each of the heads 23, the plurality of outlets may be arranged along a horizontal line tilted in the X direction. Also, the plurality of outlets in each of the heads 23 may be in a staggered arrangement.

An object on which an image is to be record in the inkjet printer 1 may be a base material in a shape of a plate or a film formed of plastic or the like, other than the recording paper 9.

The structures described above in the preferred embodiment and the modifications can be appropriately combined unless contradiction arises.

While the invention has been shown and described in detail, the foregoing description is in all aspects illustrative and not restrictive. It is therefore understood that numerous modifications and variations can be devised without departing from the scope of the invention. This application claims priority benefit under 35 U.S.C. Section 119 of Japanese Patent Application No. 2011-216091 filed in the Japan Patent Office on Sep. 30, 2011, the entire disclosure of which is incorporated herein by reference.

REFERENCE SIGNS LIST

1 Inkjet printer
2 Recording part
3 Paper feeding mechanism
4 Control part
9 Recording paper
70 Basic waveform
71, 72 Waveform-element sequence
241 Outlet
711 First minute pulse
712 Second minute pulse
713 First ejection pulse
721 Second ejection pulse
722 Third ejection pulse
S11-S13 Step

The invention claimed is:

1. An inkjet printer, comprising:

a recording part for ejecting droplets of ink from an outlet toward an object, to form dots of at least one size on said object;

a moving mechanism for moving said object relatively to said recording part in a moving direction; and a controller for sequentially inputting signals to said recording part, said signals being instructions for ejection of droplets, in parallel with movement of said object relative to said recording part, wherein a driving signal used for ejection of a droplet is generated by selecting a part of a plurality of waveform elements included in a basic waveform in accordance with instructions given by said controller, said plurality of waveform elements include an ejection pulse used for ejection of a droplet and a plurality of minute pulses preceding said ejection pulse, in forming no dot on said object, a first minute pulse group which is at least a part of said plurality of minute pulses is selected, to achieve non-ejection in said recording part, in forming a dot of one size included in said at least one size, a second minute pulse group which is at least a part of said plurality of minute pulses and said ejection pulse are selected, to achieve ejection of a droplet from said outlet, said first minute pulse group and said second minute pulse group have different waveforms, said basic waveform is two waveform-element sequences running in parallel with each other, and said plurality of minute pulses are included in one of said two waveform-element sequences.

2. The inkjet printer according to claim 1, wherein said plurality of minute pulses are two minute pulses, and said first minute pulse group is one of said two minute pulses, and said second minute pulse group is the other minute pulse.

3. The inkjet printer according to claim 1, wherein said plurality of minute pulses are two minute pulses, and said first minute pulse group is said two minute pulses, and said second minute pulse group is one of said two minute pulses.

4. The inkjet printer according to claim 1, wherein said plurality of minute pulses are two minute pulses, and said second minute pulse group is said two minute pulses, and said first minute pulse group is one of said two minute pulses.

5. The inkjet printer according to claim 1, wherein said one waveform-element sequence includes said plurality of minute pulses and a first ejection pulse which is said ejection pulse, and the other waveform-element sequence includes a second ejection pulse occurring in parallel with said plurality of minute pulses.

6. The inkjet printer according to claim 5, wherein said other waveform-element sequence includes a third ejection pulse after said second ejection pulse, when a droplet for a large dot is ejected from said recording part, a driving signal which includes said second ejection pulse and said first ejection pulse and does not include said third ejection pulse is generated, when a droplet for a medium dot is ejected from said recording part, a driving signal which includes at least a part of said plurality of minute pulses and said first ejection pulse and does not include either said second ejection pulse or said third ejection pulse is generated, and when a droplet for a small dot is ejected from said recording part, a driving signal which includes said third ejection pulse and does not include either said first ejection pulse or said second ejection pulse is generated.

7. The inkjet printer according to claim 1, wherein said recording part includes a plurality of outlets, and said plurality of outlets are arranged to cover a whole width of a recording area of an object in a direction perpendicular to said moving direction.

8. An image recording method adopted in an inkjet printer, said inkjet printer including a recording part which ejects droplets of ink from an outlet toward an object, to form dots of at least one size on said object, said method comprising the steps of:

a) moving said object relatively to said recording part in a moving direction; and b) sequentially inputting signals which are instructions for ejection of droplets to said recording part, in parallel with movement of said object relative to said recording part, wherein a part of a plurality of waveform elements included in a basic waveform is selected, to generate a driving signal used for ejection of a droplet, said plurality of waveform elements include an ejection pulse used for ejection of a droplet and a plurality of minute pulses preceding said ejection pulse, in the course of image recording;

in forming no dot on said object, a first minute pulse group which is at least a part of said plurality of minute pulses is selected, to achieve non-ejection in said recording part;

in forming a dot of one size included in said at least one size, a second minute pulse group which is at least a part of said plurality of minute pulses and said ejection pulse are selected, to achieve ejection of a droplet from said outlet, said first minute pulse group and said second minute pulse group have different waveforms, said basic waveform is two waveform-element sequences running in parallel with each other, and said plurality of minute pulses are included in one of said two waveform-element sequences.

9. The image recording method according to claim 8, wherein said plurality of minute pulses are two minute pulses, and said first minute pulse group is one of said two minute pulses, and said second minute pulse group is the other minute pulse.

10. The image recording method according to claim 8, wherein said plurality of minute pulses are two minute pulses, and said first minute pulse group is said two minute pulses, and said second minute pulse group is one of said two minute pulses.

11. The image recording method according to claim 8, wherein said plurality of minute pulses are two minute pulses, and said second mute pulse group is said two minute pulses, and said first minute pulse group is one of said two minute pulses.

12. The image recording method according to claim 8, wherein said one waveform-element sequence includes said plurality of minute pulses and a first ejection pulse which is said ejection pulse, and the other waveform-element sequence includes a second ejection pulse occurring in parallel with said plurality of minute pulses.

13. The image recording method according to claim 12, wherein said other waveform-element sequence includes a third ejection pulse after said second ejection pulse, when a droplet for a large dot is ejected from said recording part, a driving signal which includes said second ejection pulse and said first ejection pulse and does not include said third ejection pulse is generated, when a droplet for a medium dot is ejected from said recording part, a driving signal which includes at least a part of said plurality of minute pulses and said first ejection pulse and does not include either said second ejection pulse or said third ejection pulse is generated, and when a droplet for a small dot is ejected from said recording part, a driving signal which includes said third ejection pulse and does not include either said first ejection pulse or said second ejection pulse is generated.

* * * * *